US008822035B1

(12) United States Patent
Hammen et al.

(10) Patent No.: US 8,822,035 B1
(45) Date of Patent: Sep. 2, 2014

(54) ERUCAMIDE-COATED PAPER FOR TRANSFER OF A SLIP AGENT

(75) Inventors: Lee R. Hammen, Combined Locks, WI (US); Jeffrey C. Djock, Appleton, WI (US); Zachary L. Leimkuehler, Pulaski, WI (US); Corey A. Bishop, Appleton, WI (US); James J. Schneider, Green Bay, WI (US); Gary L. Keating, Kaukauna, WI (US)

(73) Assignee: Expera Specialty Solutions, LLC, Kaukauna, WI (US)

( * ) Notice: Subject to any disclaimer, the term of this patent is extended or adjusted under 35 U.S.C. 154(b) by 286 days.

(21) Appl. No.: 13/218,888

(22) Filed: Aug. 26, 2011

Related U.S. Application Data

(60) Provisional application No. 61/383,802, filed on Sep. 17, 2010.

(51) Int. Cl.
*B32B 23/04* (2006.01)

(52) U.S. Cl.
USPC ..... 428/537.5; 427/384; 427/391; 428/532

(58) Field of Classification Search
USPC ..... 428/537.5; 427/384, 391
See application file for complete search history.

(56) References Cited

U.S. PATENT DOCUMENTS

| | | | | |
|---|---|---|---|---|
| 3,362,839 | A * | 1/1968 | Weindel | 106/270 |
| 5,547,701 | A * | 8/1996 | Nielsen et al. | 427/2.3 |
| 5,709,976 | A * | 1/1998 | Malhotra | 430/124.54 |
| 2002/0146571 | A1 * | 10/2002 | Babcock et al. | 428/438 |
| 2003/0096892 | A1 * | 5/2003 | Marsh | 524/236 |
| 2010/0297392 | A1 * | 11/2010 | Chen et al. | 428/141 |

* cited by examiner

*Primary Examiner* — Leszek Kiliman
(74) *Attorney, Agent, or Firm* — Quarles & Brady LLP

(57) ABSTRACT

An erucamide-coated paper and a methods of making the erucamide-coated paper are disclosed.

24 Claims, 4 Drawing Sheets

ERUCAMIDE-COATED PAPER FOR TRANSFER OF A SLIP AGENT

CROSS-REFERENCE TO RELATED APPLICATION

This patent application claims priority to U.S. provisional patent application Ser. No. 61/383,802 entitled "Erucamide-Coated Paper for Transfer of a Slip Agent" filed on Sep. 17, 2010. The full contents of that application are incorporated by reference as if set forth in its entirety herein.

STATEMENT OF FEDERALLY SPONSORED RESEARCH OR DEVELOPMENT

Not applicable.

BACKGROUND OF THE INVENTION

This patent application relates to coated papers and their manufacture. In particular, this application relates to coated papers configured to carry a slip agent.

One or more interleaving sheets are often used to separate objects with large flat surfaces during storage or shipping. By inserting the interleaving sheets between the objects, the otherwise adjacent surfaces of the objects will not directly bear on one another. This helps to minimize damage to the surfaces as a result of scratching which can occur, for example, due to the presence of debris between the surfaces. Moreover, in certain applications, these sheets may advantageously protect the surfaces from exposure to the surrounding atmosphere.

For many applications, the interleaving sheets need to be more than merely cellulose-based paper. Often the inclusion of polymeric films is required to provide the necessary tribological properties. These films may either be present on the interleaving sheets as a coating layer or be applied directly to the surface of the objects by lamination or the like. Unfortunately, however, this adds additional steps which increase the cost and complexity of the process and, in the case of polymeric layers coating the product, can adversely affect the ability of the interleaving sheet to be re-pulpable and recyclable.

Hence, a need exists for improved interleaving sheets. In particular, a need exists for interleaving sheets which provide excellent separation characteristics without complicated application processes and without compromising re-pulpability and recycling qualities of the paper.

SUMMARY OF THE INVENTION

This disclosure presents a novel erucamide-coated paper and a method of making this paper in which the erucamide in the erucamide-coated paper is a slip agent that is readily transferable from the paper to a contacting surface.

Although some have contemplated using interleaving sheets to transfer a slip agent from the interleaving sheets to contacting surfaces, to date there has been no adequate way to manufacture such a product. Because erucamide is not soluble in water and has a high melting temperature, it has been of limited use in paper-making processes. It had been widely believed that the only way to apply a "layer" of erucamide would be to place the erucamide in a polymeric film (typically containing polyolefins) which might either be attached to a paper substrate or laminated to the contacting surfaces of the objects to be separated. Unfortunately, placing erucamide in a polymeric film either adds cost and complexity to the process (i.e., adds a laminating step in which the polymeric film is applied to the surface to be protected) or destroys the re-pulpability and recyclability of the paper substrate to which the polymeric film is attached. The methods disclosed below place the erucamide on a cellulose-based paper substrate without compromising the re-pulpability or recyclability of the paper.

Moreover, the application of erucamide to the surface of the paper and in some cases, the additional impregnation of the paper with erucamide, provides interleaving sheets with enhanced surface characteristics. The resultant erucamide-coated paper has increased release properties, a reduction in the coefficient of friction, and increased lubricity.

These and still other advantages of the invention will be apparent from the detailed description and drawings. What follows is merely a description of some preferred embodiments of the present invention. To assess the full scope of the invention, the claims should be looked to as these preferred embodiments are not intended to be the only embodiments within the scope of the claims.

DETAILED DESCRIPTION OF THE PREFERRED EMBODIMENTS

Figure 1:
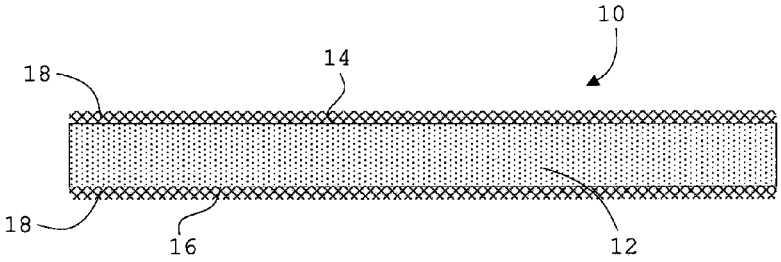
FIG. 1 is a schematic representation of an erucamide-coated paper.

Referring first to FIG. 1, an erucamide-coated paper 10 is shown. The erucamide-coated paper 10 includes a cellulose-based paper substrate 12 having two opposing faces 14 and 16. In the form shown in FIG. 1, an erucamide coating 18 is applied to each of the two opposing faces 14 and 16 of the cellulose-based paper substrate 12. In other forms, however, the erucamide coating 18 may be applied to only one side of the cellulose-based paper substrate 12 or may only be applied to portions of the cellulose-based paper substrate 12.

While FIG. 1 depicts the erucamide coating 18 as a full and continuous layer located on the surface of the cellulose-based paper substrate 12, it should be appreciated that, in reality, the structure may deviate from this form. For example, depending on the method of application, at least a portion of the erucamide coating 18 may penetrate into the web of the cellulose-based paper substrate 12, thereby impregnating the substrate 12, and the excess erucamide coating may then aggregate on the faces 14 and 16 of the substrate 12. Moreover, in some forms, the thickness and arrangement of the applied erucamide may be such that although the paper is coated with erucamide, the erucamide does not form a continuous layer.

As will be described in more detail below, the amount of erucamide applied to the paper is typically in the range of 0.1 to 1.6 lbs per ream. A ream as used herein is approximately 3,000 $ft^2$ in one-sided area or 6,000 $ft^2$ in total surface area, given that the paper has two sides. This equates to the application rate of erucamide per surface area covered in an amount of $1.6\times10^{-5}$ $lb/ft^2$ to $26.7\times10^{-5}$ $lb/ft^2$.

In any event, the quantity and arrangement of the erucamide coating on the paper substrate is such that the erucamide is configured to be transferred from the cellulose-based paper substrate to another surface. This means that the erucamide is applied such that some excess amount on the faces 14 and 16 remains available for transfer to a contacting surface.

Also, notably, the erucamide coating is substantially free of polyolefins. Conventionally, as erucamide is not soluble in water, when erucamide has been added to thin films or paper, the erucamide is part of a polymeric film and then some of the erucamide migrates to the surface of the film. Inclusion of the erucamide in a polymeric film had been considered necessary because erucamide is not soluble in water, and for this reason, could not be readily applied as a separate coating to paper.

Unfortunately, the fact that if erucamide was to be included then it needed to be placed in a polymeric layer according to conventional processes has many downsides which, to date, have been accepted as necessary. The biggest problem with placing erucamide in a polymeric film is that it adversely affects the re-pulpability of the paper and, further, renders any paper substrate un-recyclable. Moreover, mixing erucamide into a polymeric mixture and either forming a film from this mixture or extruding a polymeric film onto paper complicates and adds expense to the process.

Because the erucamide of the paper 10 is applied according to the methods disclosed below, the erucamide-coated paper 10, however, is substantially free of polyolefins and is fully re-pulpable and recyclable. A standard that may be used to determine whether the erucamide-coated paper is re-pulpable is TAPPI (Technical Association of the Pulp and Paper Industry) Standard UM 213.

Figure 2:
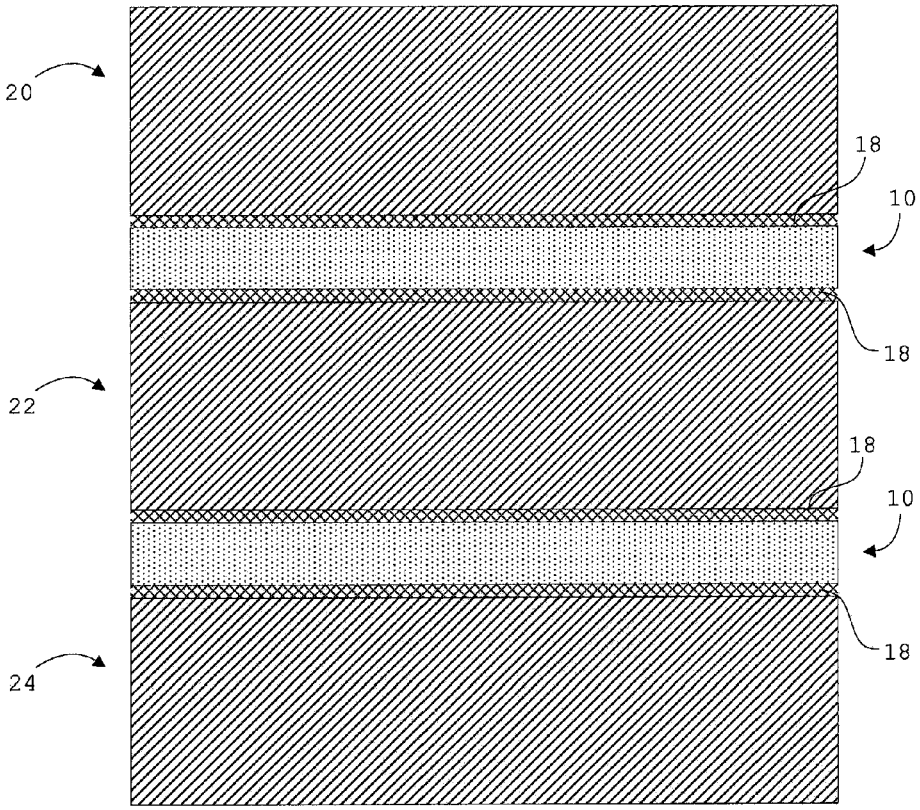
FIG. 2 is a schematic representation of three objects with the erucamide-coated paper of FIG. 1 there between, in which the erucamide on the erucamide-coated paper is placed into contact with the flat planar surfaces of the objects.
Figure 3:
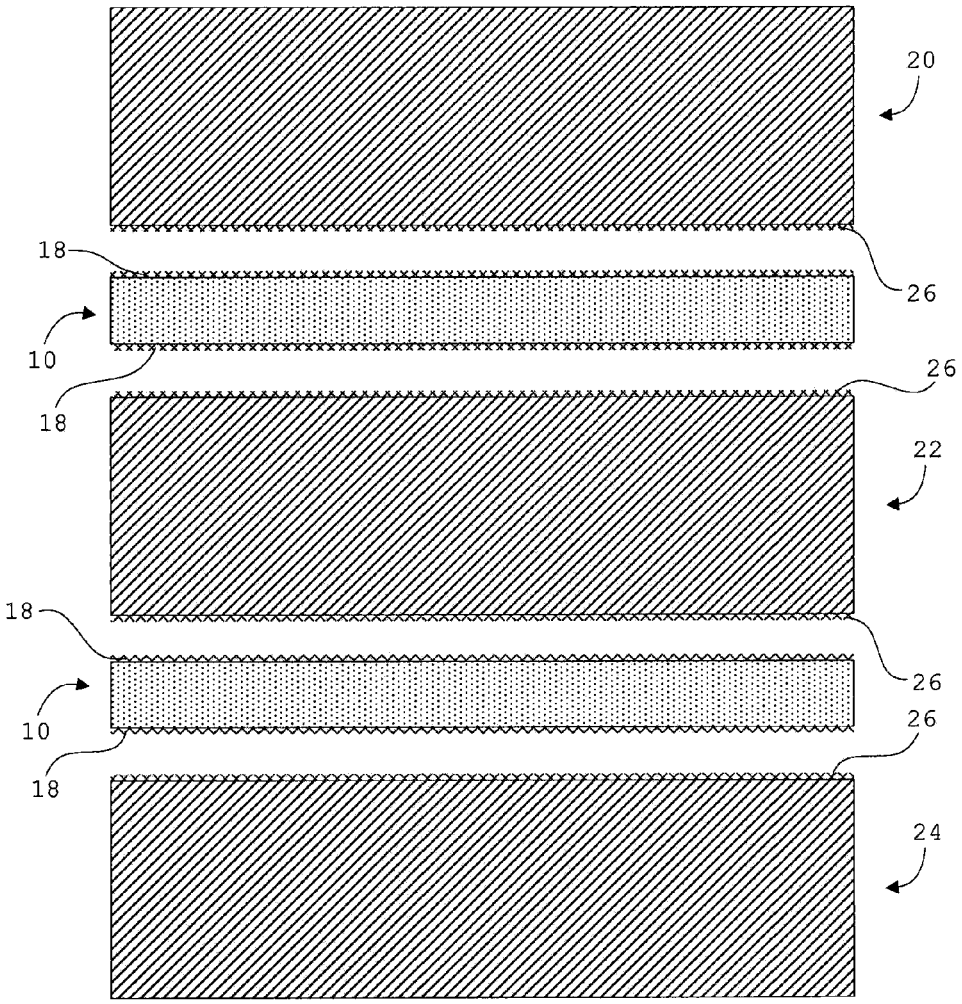
FIG. 3 is a schematic representation similar to FIG. 2, but in which the objects and the erucamide-coated paper have been separated from one another and a portion of the erucamide has been transferred from the erucamide-coated paper to the planar surfaces of the objects.

Referring now to FIGS. 2 and 3, one potential application of the erucamide-coated paper is shown. In FIG. 2, three objects 20, 22, and 24 are placed in parallel with one another. In the space between each of the planar surfaces of the three objects 20, 22, and 24, the erucamide-coated paper 10 is inserted as an interleaving sheet. The erucamide coating 18 on each side of the paper 10 contacts one of the planar surfaces of the three objects 20, 22, and 24.

When the erucamide coating 18 on the erucamide-coated paper 10 contacts the planar surfaces, at least a portion of the erucamide adheres to the surfaces. This adhesion may, at least to some degree, protect the surface of the objects 20, 22, and 24 from the surrounding environment. Moreover, as erucamide is a slip agent, if the objects 20, 22, and 24 move relative to one another, the erucamide on the erucamide-coated paper 10 facilitates smooth sliding due to a reduced coefficient of friction and reduces the likelihood of the surfaces scratching.

Advantageously, only a single interleaving sheet need be placed between each pair of adjacent objects 20, 22, and 24. As each interleaving sheet includes an erucamide coating 18 on both sides, it is relatively simple to insert the erucamide-coated paper 10 between the adjacent objects 20, 22, and 24 to protect them during storage and/or shipping. In contrast, if the interleaving sheets were to be both cellulose-based and further include erucamide in a polymer film, the polymer film would either need to be applied onto the cellulose-based substrate or would need to include separate stacked sheets. Multiple layer configurations might include two separate polymer films sandwiching a paper sheet or an arrangement in which the polymer films might be laminated to the surface of the objects and a sheet of paper is placed between the laminated surfaces.

When the objects 20, 22, and 24 are later separated from one another, as illustrated in FIG. 3, at least a portion of the erucamide 26 is transferred from the erucamide-coated paper 10 to the planar surface of the objects 20, 22, and 24. Depending on the particular process being employed, it may be beneficial to keep the erucamide on these planar surfaces or to remove the transferred portion of erucamide 26 by washing or the like.

Referring now to FIGS. 4 through 7, a number of methods for applying erucamide to a cellulose-based paper substrate are shown. The application of erucamide to the paper substrate constitutes only a section of the larger paper-making process. Typically, the paper substrate will be fabricated using traditional paper-making processes that utilize, for example, a Fourdrinier Machine. Accordingly, it should be appreciated that the schematics only illustrate the steps of the process for erucamide application and that there may be other steps in process both upstream and downstream of the process steps illustrated in FIGS. 4 through 7.

According to the methods that will be described below, the erucamide is applied in one of two forms to the cellulose-based paper substrate. Both of these forms of the erucamide are substantially free of polyolefins which can adversely affect the re-pulpability and the recycling of the paper. In one form, the erucamide is placed in an erucamide emulsion/dispersion with water (and in some cases a thickener may be added) and then applied to the cellulose-based paper substrate by a size press as in FIG. 4 or by spraying as in FIGS. 5 and 6. In another form, a pure or nearly pure (trials were run with 95-99.6% purity) erucamide is melted and applied by a waxer as in FIG. 7.

Figure 4:
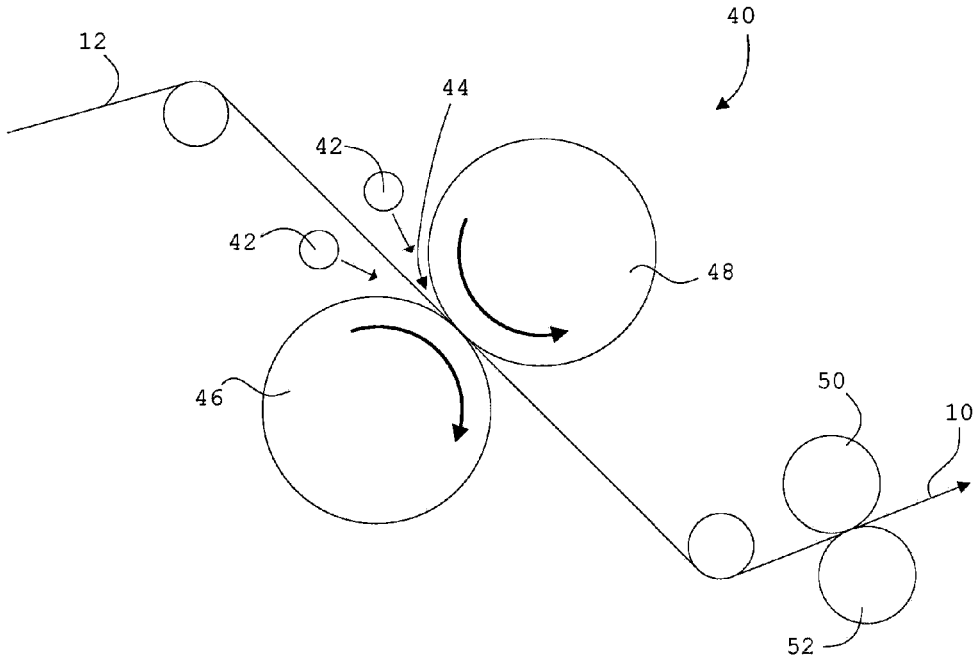
FIG. 4 is a schematic illustrating a method of applying an erucamide emulsion to a cellulose-based paper substrate using a size press.

In FIG. 4, a size press 40 is used to apply an erucamide emulsion to the cellulose-based paper substrate 12. As shown in the schematic illustration, the web of the cellulose-based paper substrate 12 is fed from the left of the schematic between a pair of applicators 42 which provide the erucamide emulsion/dispersion to the cellulose-based paper substrate 12 proximate the nip point 44 of two rollers 46 and 48 of the size press 40. A small pool may form at the nip point 44 which helps to simultaneously coat the two opposing faces 14 and 16 of the cellulose-based paper substrate 12 with the erucamide emulsion. Further, to some extent, the size press 40 may cause the impregnation of the erucamide emulsion into the bulk of the cellulose-based paper substrate 12 by mashing the erucamide into the paper. Of course, the amount of impregnation that could occur is related to the density of the paper as it enters the size press 40.

After the erucamide emulsion has been applied to the cellulose-based paper substrate 12 and run through the size press 40, the as-applied erucamide emulsion is heated using drier cans 50 and 52 or other heaters to drive off the water from the emulsion/dispersion. Accordingly, at the far right end of the schematic of FIG. 4, an erucamide-coated paper 10 is formed.

For the size press method of application, the erucamide emulsion/dispersion is in the form of a 10% emulsion having particle sizes ranging from 20 to 70 microns. Application rates of the erucamide to the cellulose-based paper substrate 12 for this application method is typically in the range of 0.2 to 0.6 lbs per 3,000 $ft^2$ of paper (having 6,000 $ft^2$ surface area). This is the combined coat weight for both sides of the paper.

Additionally, a thickener may be added to the erucamide emulsion/dispersion such as, for example, ethylated starch, carboxymethyl cellulose, sodium alginate, waxy maize starch and various polyacrylates. As seen in Table 1 below, the type and amount of thickener can affect the water drop and TLMI release testing values of the erucamide-coated paper.

TABLE 1

| | | Water Drop | | Tape Pull | |
|---|---|---|---|---|---|
| Solution | Pick-up lbs/ton | Glossy | Non Glossy | Glossy | Non Glossy |
| Control | 0 | 4:50 | 4:45 | 127 | 145 |
| Erucamide | 36 | 7:10 | 5:30 | 128 | 132 |
| Erucamide/ Alginate | 31/2 | 9:30 | 6:30 | 139 | 128 |
| Erucamide/ Ethylated Starch | 19/5 | 14:20 | 9:20 | 93 | 103 |
| Erucamide/ CMC | 26/4 | 12:20 | 10:15 | 94 | 96 |
| Erucamide/ Waxy Starch | 28/4 | 5:45 | 5:15 | 139 | 141 |
| Erucamide/ 289 | 20/3 | 10:45 | 10:15 | 102 | 95 |
| Erucamide/ 1228 | 30/3 | 10:00 | 9:30 | 115 | 118 |

The pick-up lbs/ton column in Table 1 identifies the amount of erucamide and thickener applied per ton (2,000 lbs) of paper for each trial. For example, Erucamide/Ethylated Starch has 19 lbs of erucamide and 5 lbs of ethylated starch applied per 2,000 lbs of paper.

Water drop tests were taken for each sample to determine how long it took a drop of water to penetrate the sample. Higher water drop times indicate that it took a longer time for a drop of water to penetrate the sample. As the underlying paper fiber densities of the samples were equal and the only variable was the type and amount of thickener, a higher water drop time indicates greater amounts of erucamide being present at the surface of the paper as a result of the use of certain thickeners, as erucamide is a known water repellant.

Tape pull tests were also run to measure the release characteristics of each sample. The measurements are in grams/inch. Lower tape pull measurements mean that the tape is removed from the paper with less force. Low tape pull measurements are suggestive of greater amounts of erucamide on the surface of the paper.

According to these tests, the combination of erucamide with an ethylated starch thickener provides a final erucamide-coated paper morphology in which the erucamide is more present at the surface than in the bulk of the paper because of the addition of the thickener. As a corollary, because the erucamide is preferentially located at the surface of the substrate, it is believed the excess surface erucamide is more readily transferable from the surface of the paper to another surface.

Figure 5:
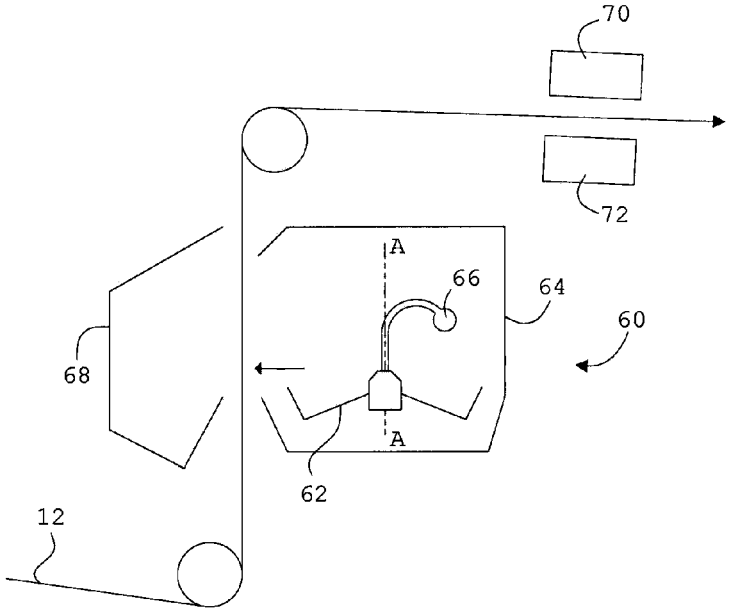
FIG. 5 is a schematic illustrating a method of applying an erucamide emulsion to a cellulose-based paper substrate using a rotary disc spray process.
Figure 6:
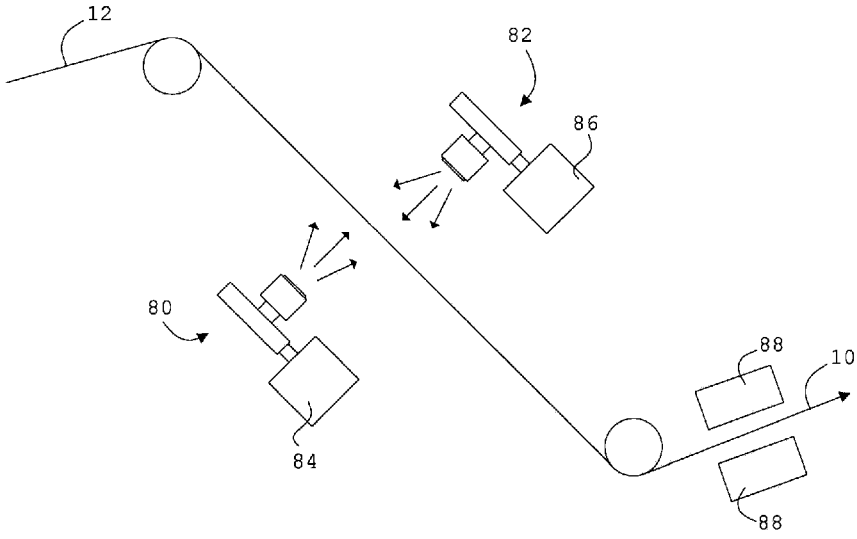
FIG. 6 is a schematic illustrating a method of applying an erucamide emulsion to a cellulose-based paper substrate using pressurized spray nozzles.

Turning now to FIGS. 5 and 6, the erucamide emulsion/dispersion is applied using one of two sprayer coating methods.

Looking first at FIG. 5, a rotor application system 60, such as those made by WEKO of Germany, is used to apply an erucamide emulsion/dispersion to the cellulose-based paper substrate 12 that is fed from the left of the schematic. The cellulose-based paper substrate 12 is fed vertically upward through the rotor application system 60 which has two sides. On the right side of the rotor application system 60, rotating discs 62 (only one of which is illustrated from the side view of FIG. 5) spin about an axis of rotation A-A inside a housing 64. The erucamide emulsion/dispersion is fed onto the rotating discs 62 from a fluid source 66 which may be continually agitated to keep the emulsion/dispersion homogenous. As the discs 62 spins and the emulsion is applied to the discs 62, the discs 62 spray the erucamide emulsion/dispersion through an open side of the housing 64 and onto the cellulose-based paper substrate 12. The spray pattern may be limited by the use of apertures or the like (not shown) on the housing 64 to ensure an even distribution of the erucamide coating. On the left side of the rotor application system 60, a collection basin 68 may collect any excess spray which is not applied to the substrate 12 as it passes through the rotor application system 60. After the coating is applied, drier elements 70 and 72 may be used to raise the temperature to remove the excess moisture from the now-coated paper and to assist in adhering the applied erucamide to the cellulose-based paper substrate 12.

As depicted in FIG. 5, the rotor application system 60 is configured such that only a single side of the cellulose-based paper substrate 12 is coated. However, both sides of cellulose-based paper substrate 12 could be coated by either adding a second rotor application system downstream in the process or by performing multiple passes in which the orientation of the paper is flipped to expose the other face of the substrate 10 to the spray of the rotors on the second pass.

Turning now to FIG. 6, an alternative method of spraying is illustrated that incorporates the use of pressurized spray nozzles. In this form of application, two rows of spray nozzles 80 and 82 are mounted to bars 84 and 86, respectively, on either side of the path of the cellulose-based paper substrate 12. The sets of spray nozzles 80 and 82 are pressure fed the erucamide emulsion/dispersion using tubing or the like (not shown). As the cellulose-based paper substrate 12 is fed past the rows of spray nozzles 80 and 82, the spray nozzles 80 and 82 spray the erucamide coating onto the cellulose-based paper substrate 12. After application of the erucamide coating the paper 10 is fed forward to additional drying elements 88 which assist in removing the moisture of applied coating.

For the spraying methods of application, the erucamide emulsion is in the form of a 20% emulsion/dispersion having particle sizes ranging from 1.0 to 20 microns. Application rates of the erucamide to the cellulose-based paper substrate 12 for these spraying application methods are typically in the range of 0.1 to 1.0 lbs per 3,000 $ft^2$ of paper (again, having 6,000 $ft^2$ surface area). This is the combined coat weight for both sides of the paper.

Figure 7:
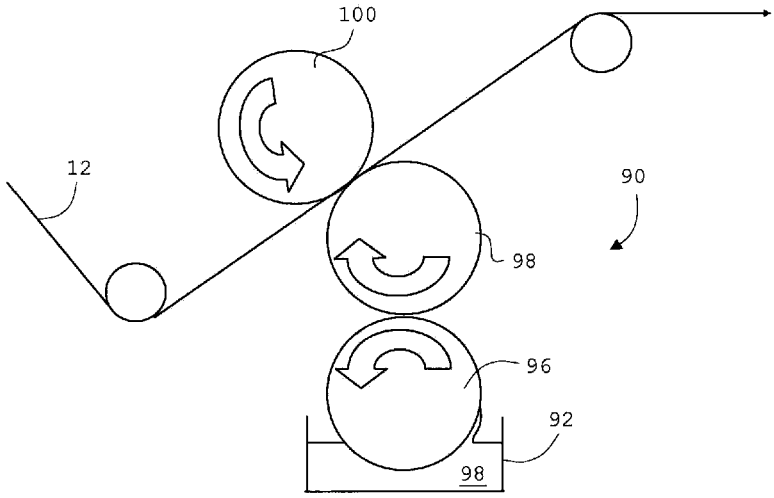
FIG. 7 is a schematic illustrating a method of applying erucamide to a cellulose-based paper substrate using a waxer.

Referring now to FIG. 7, yet another method of applying an erucamide coating to the paper substrate is shown. In FIG. 7, a waxer 90, such as the CM-203 Hot-Melt Waxer made by CMS, is used to apply a molten erucamide melt to the surface of the cellulose-based paper substrate 12 which is fed past the waxer 90. A tray 92 of the waxer 90 holds heated erucamide 94 which has been heated and maintained at a temperature in excess of its melt temperature of 170° F.

A series of rollers transfer the melted erucamide 94 from the tray 92 to the substrate 12. A pickup roller 96 has a portion which is submerged in the heated erucamide 94. As the pickup roller 96 is rotated, the heated erucamide 94 is carried on the surface of the pickup roller 96 out of the molten bath. The erucamide 94 is carried on the pickup roller 96 until the pickup roller 96 transfers the erucamide to a heated application roller 98. The heated application roller 98 may be heated using hot oil or the like, which can be circulated within the heated application roller 98. As the heated application roller 98 is rotated, the melted erucamide 94 is carried by the roller 98 toward the substrate 12 at a nip point between the heated application roller 98 and another roller 100. When the melted erucamide on the heated application roller 98 is brought into contact with the cellulose-based paper substrate 12, the erucamide is, at least in part, transferred from the surface of the heated application roller 98 to the contacting face of the substrate 12, thereby coating one side of the substrate 12 in erucamide.

Again, the illustrated configuration only coats a single face of the substrate 12. To coat both sides, a second downstream waxer could be employed or the substrate 12 may be passed through the waxer 90 in two different orientations.

As the melt is nearly 100% erucamide (test runs were performed using 95 to 99.6% pure amide content), the waxer 90 will typically achieve a greater application rate of erucamide than the size press or spraying forms of application. Up to 1.6 lbs of erucamide may be applied to a 3,000 $ft^2$ ream of paper (6,000 $ft^2$ total surface area) using the waxer.

To compare the various forms of erucamide application, tape release testing was performed on various samples including a control sample with no coating, spray coated samples at various coating weights, size pressed samples created in separate trial runs, and waxed samples at various weights. Table 2 below lists the various samples prepared and tested at a TLMI speed setting of 12 inches per minute at 180 degrees with one inch wide 3M tape adhesive #3051.

TABLE 2

| Sample Coating | Coat Weight (lbs/ream) | Release (grams/inch) |
|---|---|---|
| Uncoated substrate | 0.00 | 142.0 |
| Spray coated | 0.11 | 90.3 |
| Spray coated | 0.23 | 82.4 |
| Spray coated | 0.34 | 68.3 |
| Spray coated | 0.46 | 64.8 |
| Spray coated | 0.57 | 58.3 |
| Spray coated | 0.69 | 56.9 |
| Spray coated | 0.80 | 55.0 |
| Spray coated | 0.92 | 44.3 |
| Size press (Trial 1) | 0.38 | 94.2 |
| Size press (Trial 2) | 0.36 | 92.2 |
| Size press (Trial 3) | 0.38 | 91.5 |
| Waxer | 1.5 | 29.2 |
| Waxer | 1.6 | 20.8 |

Many observations can be made from these results. First, generally speaking, the greater the coat weight, the easier the tape releases from the substrate. This suggests that the addition of a thicker coating results in more excess erucamide being located at the surface of the erucamide-coated paper. Second, those methods of application which tend to apply the erucamide to the surfaces of the substrate, instead of impregnating the bulk of the substrate, more effectively reduce the release values. Comparing the size press to spray coating application methods at similar coat weights of about 0.35 lbs/ream, the spray coating method better places the erucamide in a location at which it could be easily transferred off the substrate (as illustrated by lower release measurements).

Although an interleaving sheet has been described with erucamide as the applied slip agent, it is contemplated that the other long chain fatty amides could also be used in the place of erucamide including ethylene bis stearamide and oleamide.

It should be appreciated that various other modifications and variations to the preferred embodiments can be made within the spirit and scope of the invention. Therefore, the invention should not be limited to the described embodiments. To ascertain the full scope of the invention, the following claims should be referenced.

What is claimed is:

1. A method of making an erucamide-coated paper, the method comprising:

providing a cellulose-based paper substrate having two opposing faces;

applying erucamide to at least one of the two opposing faces of the cellulose-based paper substrate to form an erucamide-coated paper;

wherein the erucamide is applied to the cellulose-based paper substrate in an amount of at least $1.6\times10^{-5}$ $lb/ft^2$ per side coated.

2. The method of claim 1, wherein the erucamide-coated paper is re-pulpable and recyclable.

3. The method of claim 2, wherein the erucamide-coated paper is substantially free of polyolefins.

4. The method of claim 1, wherein the erucamide is applied to the cellulose-based paper substrate by a size press.

5. The method of claim 4, further comprising the step of blending the erucamide with a thickener prior to the step of applying the erucamide to the cellulose-based paper substrate.

6. The method of claim 1, wherein the erucamide is applied to the cellulose-based paper substrate by spraying.

7. The method of claim 6, further comprising the step of placing the erucamide in an emulsion and thereafter performing the step of applying the erucamide to the cellulose-based paper substrate by spraying.

8. The method of claim 1, wherein the erucamide is applied to the cellulose-based paper substrate by a waxer.

9. The method of claim 1, wherein the erucamide is applied to the cellulose-based paper substrate in an amount of $1.6\times10^{-5}$ $lb/ft^2$ to $26.7\times10^{-5}$ $lb/ft^2$ per side coated.

10. The method of claim 1, wherein the step of applying erucamide to the cellulose-based paper substrate includes applying the erucamide to both of the two opposing faces of the cellulose-based paper substrate.

11. An erucamide-coated paper made according to the method of claim 1.

12. An erucamide-coated paper comprising:

a cellulose-based paper substrate having two opposing faces; and an erucamide coating on at least one of the two opposing faces of the cellulose-based paper substrate;

wherein the erucamide is applied to the cellulose-based paper substrate in an amount of at least $1.6\times10^{-5}$ $lb/ft^2$ per side coated.

13. The erucamide-coated paper of claim 12, wherein the erucamide-coated paper is re-pulpable and recyclable.

14. The erucamide-coated paper of claim 13, wherein the erucamide-coated paper is substantially free of polyolefins.

15. The erucamide-coated paper of claim 12, wherein the erucamide is applied to the cellulose-based paper substrate in an amount of $1.6\times10^{-5}$ $lb/ft^2$ to $26.7\times10^{-5}$ $lb/ft^2$ per side coated.

16. The erucamide-coated paper of claim 12, wherein the erucamide is applied to both of the two opposing faces of the cellulose-based paper substrate.

17. A method of making an erucamide-coated paper, the method comprising:

providing a cellulose-based paper substrate having two opposing faces; and applying erucamide to at least one of the two opposing faces of the cellulose-based paper substrate to form the erucamide-coated paper;

wherein the erucamide-coated paper is substantially free of polyolefins;

wherein the erucamide is applied to the cellulose-based paper substrate in an amount of $1.6\times10^{-5}$ lb/ft$^2$ to $26.7\times10^{-5}$ lb/ft$^2$ per side coated.

18. The method of claim 17, wherein the erucamide-coated paper is re-pulpable and recyclable.

19. The method of claim 17, wherein the erucamide is applied to the cellulose-based paper substrate by a size press.

20. The method of claim 19, further comprising the step of blending the erucamide with a thickener prior to the step of applying the erucamide to the cellulose-based paper substrate.

21. The method of claim 17, wherein the erucamide is applied to the cellulose-based paper substrate by spraying.

22. The method of claim 21, further comprising the step of placing the erucamide in an emulsion and thereafter performing the step of applying the erucamide to the cellulose-based paper substrate by spraying.

23. The method of claim 17, wherein the erucamide is applied to the cellulose-based paper substrate by a waxer.

24. The method of claim 17, wherein the step of applying erucamide to the cellulose-based paper substrate includes applying the erucamide to both of the two opposing faces of the cellulose-based paper substrate.

* * * * *